United States Patent [19]

Peterson et al.

[11] 4,339,316

[45] Jul. 13, 1982

[54] INTERMEDIATE LAYER FOR SEATING RHM TUBES IN CATHODE BLOCKS

[75] Inventors: Richard W. Peterson, Lower Burrell; Perry A. Foster, Jr., New Kensington, both of Pa.

[73] Assignee: Aluminum Company of America, Pittsburgh, Pa.

[21] Appl. No.: 188,985

[22] Filed: Sep. 22, 1980

[51] Int. Cl.[3] ..... C25C 7/00; C25C 3/06; C25C 7/02

[52] U.S. Cl. ..... 204/243 R; 204/67; 204/280; 204/294

[58] Field of Search ..... 204/67, 243 R, 280, 204/290 R, 279, 294

[56] References Cited

U.S. PATENT DOCUMENTS

| | | | |
|---|---|---|---|
| 4,071,420 | 1/1978 | Foster et al. | 204/67 |
| 4,181,583 | 1/1980 | Steiger et al. | 204/67 |
| 4,247,381 | 1/1981 | Schirnig et al. | 204/225 |
| 4,265,717 | 5/1981 | Wiltzius | 204/67 |
| 4,290,874 | 9/1981 | McMonigle et al. | 204/243 P |

OTHER PUBLICATIONS

Wiltzius, U.S. Ser. No. 92,441, filed Nov. 8, 1979.

McMonigle et al., U.S Ser. No. 162,754, filed Jun. 25, 1980.

*Primary Examiner*—F. Edmundson

*Attorney, Agent, or Firm*—Glenn E. Klepac

[57] ABSTRACT

A cathode for an electrolytic cell operated at elevated temperature, the cathode comprising a refractory hard metal (RHM) body embedded in a carbonaceous base. The cathode is provided with an intermediate layer of fibrous material between a side wall of a seat in the base and a wall segment of the RHM body. The layer preferably comprises low-density carbon felt, and the layer prevents breakage of the RHM body by providing a cushion against differential thermal expansion and contraction of the base and body, especially during cell start-up.

11 Claims, 2 Drawing Figures

INTERMEDIATE LAYER FOR SEATING RHM TUBES IN CATHODE BLOCKS

BACKGROUND OF THE INVENTION

The present invention relates to cathodes for use in electrolytic cells operated at elevated temperatures. More specifically, the invention relates to an improved construction for cathodes comprising brittle refractory hard metal (RHM) elements seated in a carbonaceous base.

Cathodes comprising RHM elements are described in Foster et al U.S. Pat. No. 4,071,420, issued Jan. 31, 1978. In a preferred embodiment, the cathodes of the Foster et al patent are hollow sintered bodies of $TiB_2$ extending upwardly from a floor of an electrolytic cell, through a metal pad, and toward an anode. Cathodes of the type described in the Foster et al patent are highly effective for production of aluminum after they are heated to an elevated operating temperature. However, it has been found that the hollow sintered $TiB_2$ portions of such cathodes are brittle and subject to cracks and breakage if not protected from thermal shock, especially in the initial heat-up or start-up stages of cell operation.

A method and apparatus for protecting RHM elements from thermal shock during cell start-up are disclosed in Wiltzius U.S. patent application Ser. No. 92,441, filed Nov. 8, 1979. The three shock protecting components in a preferred form of the Wiltzius invention are plugs of CuAl alloy inside the hollow RHM elements; sleeves of insulating material extending around protruding portions of the RHM elements; and stainless steel heat dispersing jackets located externally of the insulating sleeves. The RHM elements are cemented into depressions in a carbon block. A suitable cement for attaching the RHM elements to the carbon block comprises carbon particles dispersed in a resin.

Another pertinent cell construction is shown in Steiger et al U.S. Pat. No. 4,181,583, issued Jan. 1, 1980. Steiger et al disclose several cylindrical RHM articles embedded in a carbon floor. For the purpose of insuring good electrical contact between the RHM articles and the floor, either graphite powder or graphite cement is placed between the articles and the floor.

It is a principal object of the present invention to provide an electrically conductive fibrous layer between an RHM body and a carbon base in an electrolytic cell cathode wherein the layer mechanically cushions differential thermal expansion and contraction of the body and base, thereby improving protection from thermal shock.

A related object of the present invention is to compensate for variations in sizing of RHM bodies embedded in recessed seats formed in a carbon base of an electrolytic cell.

Additional objects and advantages of the present invention will become apparent to persons skilled in the art from the following specification, considered in conjunction with the drawings.

SUMMARY OF THE INVENTION

The foregoing objects and advantages of the invention are accomplished by providing an intermediate layer of fibrous material between an RHM body and a side wall of a seat recessed from the principal surface of a carbon cathode in an electrolytic cell. In a preferred embodiment, the fibrous layer comprises carbon felt wedged between and compressed by the RHM body and a side wall of the seat.

The carbon felt intermediate layer of the present invention preferably has a density of less than about ten pounds per cubic foot, but the layer is compressed to a greater density when wedged between an RHM body and a carbon base. The layer cushions differential thermal expansion and contraction of the RHM body and base and compensates for differences in size and lack of symmetry in the RHM body.

DETAILED DESCRIPTION OF A PREFERRED EMBODIMENT

Figure 1:
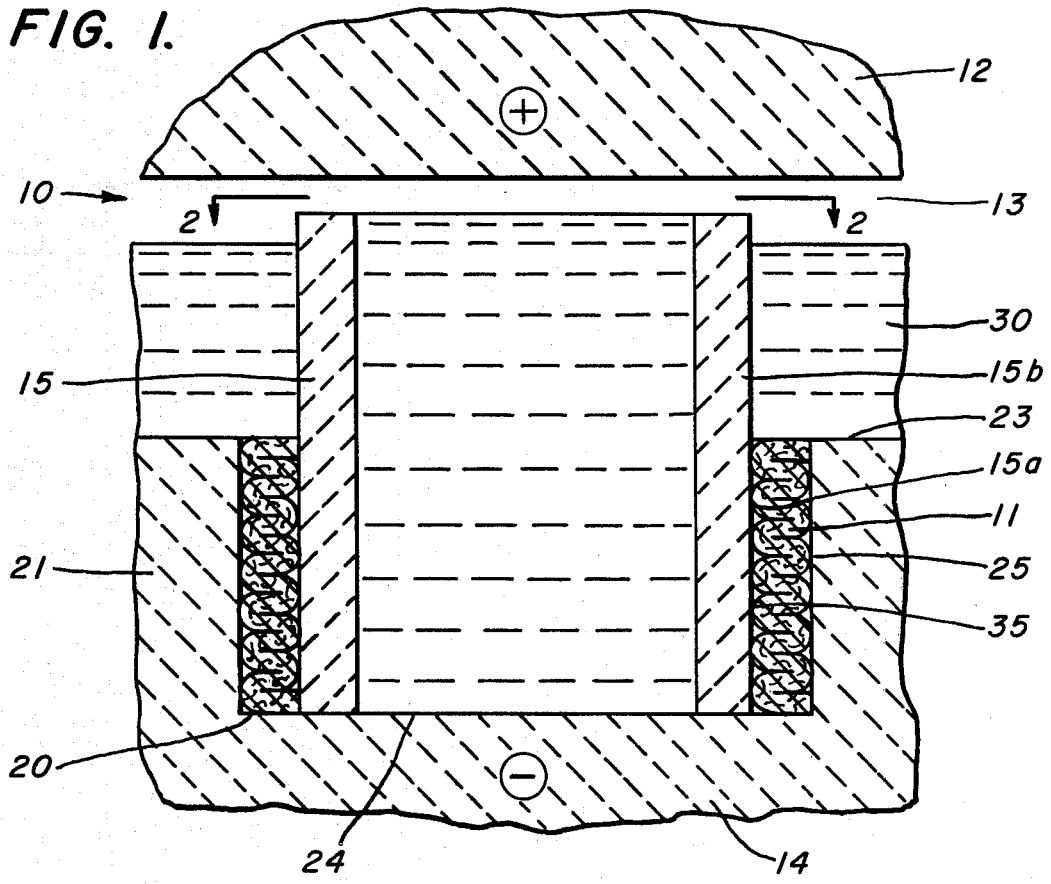
FIG. 1 is a fragmentary cross-sectional view of an electrolytic cell having a cathode provided with the fibrous carbon intermediate layer of the present invention.
Figure 2:
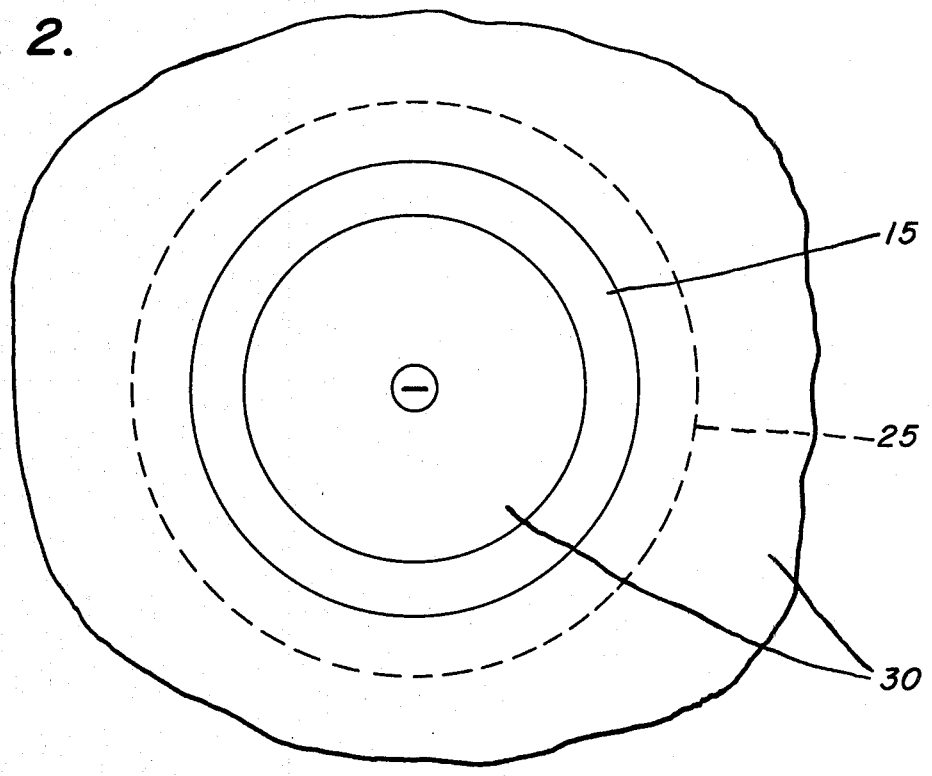
FIG. 2 is a fragmentary view taken along the lines 2—2 of FIG. 1.

A preferred embodiment of an electrolytic cell 10 having a cathode provided with a fibrous intermediate layer 11 of the present invention is shown in FIGS. 1 and 2. The electrolytic cell 10 shown therein is used for electrolytic production of aluminum. The cell is at its preferred operating temperature of about 950° to 970° C. Portions of the cell not shown are similar to the cell described and illustrated in U.S. Pat. No. 4,071,420, the disclosure of which is incorporated by reference to the extent not inconsistent with the present invention.

The electrolytic cell 10 includes a carbon anode 12, a chamber 13 for containing a compound of the metal to be produced by electrolysis, and a cathode 14. In the preferred embodiment shown, the chamber 13 contains aluminum oxide dissolved in a mixture of molten salts, and aluminum is produced by passage of current between the anode 12 and cathode 14.

The cathode 14 includes a body 15 of refractory hard metal embedded in a seat 20 formed in a cathode base comprising a carbon block 21. Bus bars (not shown) are electrically connected to the anode 12 and cathode 14. Some suitable refractory hard metals are the borides, nitrides and carbides of titanium and zirconium. $TiB_2$ and $ZrB_2$ are preferred. In the particularly preferred embodiment described herein the RHM body 15 is $TiB_2$.

The RHM body 15 is placed in a seat 20 recessed about $2\frac{1}{2}$ inches below a generally planar principal surface 23 of the block 21. The seat 20 comprises a generally cylindrical hole in the block 21. The seat 20 has a generally horizontal floor 24 and a generally vertical side wall 25 extending upwardly of the floor 24. A pad 30 of molten aluminum fills a central opening in the body 15 and covers the principal surface 23 of the block 21.

The RHM body 15 constitutes a hollow, generally cylindrical tube having a height of $4\frac{1}{2}$ inches, inside diameter of three inches, outside diameter of four inches, and a one-half inch tube thickness. The seat 20 has a diameter of five inches, leaving a generally cylindrical space having a thickness of about one-half inch between a proximal portion or lower portion **15*a* of the RHM body 15 and the side wall 25. A lowermost end portion of the RHM body 15 rests on the floor 24 and a distal portion or upper portion 15*b* of the body 15 extends about two inches upwardly of the principal surface 23 in the direction of the anode 12**.

In accordance with the present invention, an intermediate layer 11 of a fibrous material fills the space between the side wall 25 and a wall or wall segment 35 of the RHM proximal portion 15*a*. The fibrous layer 11 may be a carbonaceous material, preferably carbon or graphite. The layer may be formed of either felt or cloth. Carbon felt having a bulk density of less than about ten pounds per cubic foot in its uncompressed state is preferred. A suitable carbon felt is sold in sheet form by Fiber Materials, Inc. of Biddeford, Maine. The carbon felt sheet is compressed to fill the space between the proximal portion 15*a* and side wall 25, thereby increasing its bulk density. A hollow metal pipe fitting exteriorly of the $TiB_2$ tube 15 is a suitable packing tool for compressing the fibrous material into its space.

Persons skilled in the art will understand that various equivalents of fibrous carbonaceous material may be substituted for carbon felt without departing from the invention. For example, the intermediate layer 11 may also comprise graphite felt or graphite cloth. An equivalent material comprises several layers of carbonaceous sheet material. A suitable form of graphite sheet material is sold under the trade designation GRAFOIL by Union Carbide Corporation.

The intermediate layer 11 provides a resilient cushion between the RHM body 15 and carbon block 21. The layer 11 protects the brittle RHM body 15 against breakage caused by differences in the rates of thermal expansion of the body 15 and block 21 during start-up of the cell 10. Similar protection may also be provided when the body 15 and block 21 contract as they cool when the cell 10 is shut down for inspection or repair or replacement of various cell components.

The intermediate layer 11 also compensates for variations in sizing of the RHM body 15. While the seat 20 can be bored to close tolerances, it has been found that sizing of the outer diameter of the body 15 is very difficult to control. The intermediate layer 11 provides a cushion compensating for differences in size and symmetry of the body 15.

While the foregoing description of the present invention has been written with reference to a single preferred embodiment, persons skilled in the art will understand that various changes and modifications can be made therein without departing from the spirit and scope of the following claims. For example, the intermediate carbon felt layer of the invention can be adapted for use in a recessed seat having a tapered or conical shape instead of a cylindrical shape.

What is claimed is:

1. A cathode suitable for use in an electrolytic cell wherein metal is produced in a molten state by electrolyzing a compound of the metal in a chamber between an anode and a cathode, said cathode being spaced from the anode and comprising (a) a base having a principal surface facing the anode, said base defining a seat recessed from the principal surface, said seat including a side wall intersecting the principal surface;

(b) a body of a refractory hard metal including (1) a proximal portion carried by the base and embedded in the seat, said proximal portion including a wall segment opposed to the side wall of the seat, and (2) a distal portion extending outwardly of the principal surface in the direction of the anode; and (c) an intermediate layer of fibrous carbonaceous material for cushioning differential thermal expansion and contraction of the base and the body, said layer extending between and engaging the side wall of the seat and the wall segment of the proximal portion, said layer being recessed from said principal surface.

2. The cathode of claim 1 wherein said layer is wedged between and compressed by the side wall of the seat and the wall segment of the proximal portion.

3. The cathode of claim 1 wherein said refractory hard metal is titanium diboride.

4. The cathode of claim 1 wherein the wall segment of the proximal portion of the body is generally parallel to the side wall of the seat in the block.

5. The cathode of claim 1 wherein said fibrous material constitutes carbon or graphite.

6. The cathode of claim 1 wherein said fibrous material constitutes carbon felt.

7. The cathode of claim 6 wherein said carbon felt has a bulk density of less than about ten pounds per cubic foot.

8. The cathode of claim 1 wherein said fibrous material constitutes carbon cloth.

9. The cathode of claim 1 wherein said body comprises a hollow tube.

10. The cathode of claim 1 wherein said base comprises a carbonaceous block.

11. An electrolytic cell for production of a metal at an elevated operating temperature by electrolysis of a compound of the metal, comprising (a) an anode;

(b) a chamber for containing a compound of the metal; and (c) a cathode spaced from the anode and comprising (1) a carbonaceous base having a principal surface facing the anode, said base defining a seat recessed from the principal surface, said seat including a side wall intersecting the principal surface;

(2) a body of a refractory hard metal including a proximal portion carried by the base and embedded in the seat, said proximal portion including a wall segment opposed to the side wall of the seat, and a distal portion extending outwardly of the principal surface in the direction of the anode; and (3) an intermediate layer of fibrous carbonaceous material for cushioning differential thermal expansion and contraction of the block and the body, said layer extending between and frictionally engaging the side wall of the seat and the wall segment of the proximal portion, said layer being recessed from said principal surface.

* * * * *